US008044003B2

(12) United States Patent
Miyamoto et al.

(10) Patent No.: US 8,044,003 B2
(45) Date of Patent: Oct. 25, 2011

(54) GREASE COMPOSITION

(75) Inventors: Tetsuhiro Miyamoto, Kitaibaraki (JP); Akihiko Shimura, Kitaibaraki (JP); Tetsuhiro Kitahara, Kitaibaraki (JP); Jiro Yurimoto, Kitaibaraki (JP)

(73) Assignee: NOK Kluber Co., Ltd., Tokyo (JP)

( * ) Notice: Subject to any disclaimer, the term of this patent is extended or adjusted under 35 U.S.C. 154(b) by 583 days.

(21) Appl. No.: 12/092,098

(22) PCT Filed: Oct. 26, 2006

(86) PCT No.: PCT/JP2006/321336

§ 371 (c)(1),
(2), (4) Date: Apr. 30, 2008

(87) PCT Pub. No.: WO2007/052522

PCT Pub. Date: May 10, 2007

(65) Prior Publication Data

US 2010/0256027 A1 Oct. 7, 2010

(30) Foreign Application Priority Data

Nov. 4, 2005 (JP) ..... 2005-320750

(51) Int. Cl.
*C10M 169/00* (2006.01)
*C10M 125/24* (2006.01)
*C10M 105/50* (2006.01)

(52) U.S. Cl. ..... 508/165; 508/154; 508/181; 508/182; 508/582; 508/590

(58) Field of Classification Search ..... 508/165, 508/582, 154
See application file for complete search history.

(56) References Cited

U.S. PATENT DOCUMENTS

| | | | | |
|---|---|---|---|---|
| 5,672,640 | A * | 9/1997 | Brauer | 523/173 |
| 6,040,277 | A * | 3/2000 | Caporiccio | 508/155 |
| 2003/0060376 | A1 * | 3/2003 | Hirata et al. | 508/110 |
| 2005/0133265 | A1 * | 6/2005 | Denton et al. | 175/57 |
| 2005/0152628 | A1 * | 7/2005 | Egami et al. | 384/462 |

FOREIGN PATENT DOCUMENTS

| | | |
|---|---|---|
| JP | 54-123105 | 9/1979 |
| JP | 1-502272 | 8/1989 |
| JP | 02-308895 | 12/1990 |
| JP | 3-210394 | 9/1991 |
| JP | 03-210394 | 9/1991 |
| JP | 09-273552 | 10/1997 |
| JP | 2003-027079 | 1/2003 |
| JP | 2004-270887 | 9/2004 |

* cited by examiner

*Primary Examiner* — Ellen McAvoy
*Assistant Examiner* — Vishal Vasisth
(74) *Attorney, Agent, or Firm* — Brinks Hofer Gilson & Lione

(57) ABSTRACT

A grease composition, which comprises (A) a perfluoropolyether base oil, (B) a thickener, and (C) barium sulfate and/or antimony oxide, where 0.1-50% by weight of the component (B) and 1-25% by weight of the component (C) are contained, has a distinguished effect on improvements of abrasion resistance, friction characteristics, load durability, high-temperature durability and corrosion resistance without any deterioration of heat resistance by adding at least one of barium sulfate and antimony oxide, each having an average primary particle size of 0.1-20 μm, as component (C).

4 Claims, No Drawings

GREASE COMPOSITION

RELATED APPLICATIONS

The present application is a 35 U.S.C. §371 national stage filing of International Patent Application No. PCT/JP2006/321336, filed Oct. 26, 2006, to which priority is claimed under 35U.S.C. §120 and through which priority is claimed under 35 U.S.C. §119 to Japanese Priority Patent Application No. 2005-320750, filed Nov. 4, 2005.

This application is a 371 of PCT/JP2006/321336, filed Oct. 26, 2006.

TECHNICAL FIELD

The present invention relates to a grease composition, and more particularly to a grease composition with improved abrasion resistance against mating materials, anti-rust property (corrosion resistance), etc.

BACKGROUND ART

Grease is widely used in lubrication of various types of machinery such as automobiles, electric machines, construction machines, production lines, information equipment, industrial machines, machine tools, etc., and also members making up the above-mentioned machinery. As lubricants for use in severe circumstances, for example, at high temperatures or low temperatures, and under high loads, fluorine-based greases comprising a perfluoropolyether base oil, a fluororesin, and various additives have been widely used.

With recent trends of higher speed, smaller sizes, higher performances and lighter weight of machines, various additives are added to these fluorine-based greases to correspond to more and more severe service condition. For example, fluorine-containing organophosphorus compounds are known as fluorine-based additives having improved effects on solvent resistance, chemical resistance, mold releasability, abrasion resistance, friction resistance, etc., and in this connection, the present applicants have so far proposed a lubricating oil composition having distinguished abrasion resistance and rust prevention, based on a perfluoropolyether base oil containing a specific phosphonic acid compound, as a fluorine-based base oil. However, since phosphonic acid group resides only at one terminal of the molecule, the proposed lubricating oil composition is hard to satisfy the recently imposed requirements for higher lubricability and rust prevention at the present time.

Patent Literature 1: JP-A-2003-027079

Besides the fluorine-based additives, solid lubricants such as graphite, molybdenum disulfide, boron nitride, etc. are known to improve the lubricability, and addition of organic molybdenum compounds has been proposed to improve the abrasion resistant characteristics. However, these additives each have their own specific drawbacks. For example, graphite is chemically stable and less expensive, and has a distinguished lubricability, but any satisfactory rust prevention cannot be obtained even by adding it to perfluoropolyether base oil and fluororesin, and furthermore due to the black color peculiar to its nature, the graphite is intentionally not used with the exception of specific applications.

The following Patent Literature 2 discloses a method for forming an oxide film on the rolling surface of a bearing upon admixing a passivating oxide, but there is such a problem that any satisfactory effect cannot be attained unless the oxide film can be thoroughly formed. Furthermore, it is hard to completely satisfy the recently imposed requirements for higher heat resistance, abrasion-resistant characteristics, friction-resistant characteristics, and rust prevention.

Patent Literature 2: Japanese Patent No. 2,878,749

DISCLOSURE OF THE INVENTION

Problem to be Solved by the Invention

An object of the present invention is to provide a grease composition having distinguished improvements in abrasion resistance, friction characteristics, load resistance, high-temperature durability, corrosion resistance, etc. without impairing the heat resistance.

Means for Solving the Problem

The object of the present invention can be attained by a grease composition, which comprises (A) a perfluoropolyether base oil, (B) a thickener, and (C) barium sulfate and/or antimony oxide.

EFFECT OF THE INVENTION

The present grease composition has distinguished effects such as distinguished improvements in abrasion resistance, friction characteristics, load resistance, high-temperature durability, corrosion resistance, etc. without impairing the heat resistance, by addition of at least one of barium sulfate and antimony oxide.

BEST MODES FOR CARRYING OUT THE INVENTION

Perfluoropolyether base oil is represented by the following general formula:

$$RfO(CF_2O)p(C_2F_4O)q(C_3F_6O)rRf'$$

where Rf and Rf' each are same or different perfluoro lower alkyl groups having 1-5 carbon atoms, and p, q, and r each are 0 or positive integers, and more specifically the following compounds represented by the following general formulae are used alone or in mixture thereof:

(a) $RfO(CF_2CF_2O)m(CF_2O)nRf'$, where m+n: 3-200, and m/n: 10/90-90/10, which can be obtained by complete fluorination of a precursor formed by photooxidation polymerization of tetrafluoroethylene;

(b) $RfO[CF(CF_3)CF_2O]mRf'$, where m: 2-200, which can be obtained by complete fluorination of a precursor formed by photooxidation of hexafluoropropene, or by subjecting hexafluoropropene to anionic polymerization in the presence of a cesium fluoride catalyst, followed by treating the resulting terminal $CF(CF_3)COF$ group with a fluorine gas;

(c) $RfO[CF(CF_3)CF_2O]m(CF_2O)nRf'$, where m+n: 3-200, and m/n: 10/90-90/10, which can be obtained by complete fluorination of a precursor formed by photooxidation polymerization of hexafluoropropene.

Besides the afore-mentioned compounds, the following perfluoropolyether base oil can be used:

$$F(CF_2CF_2CF_2O)mCF_2CF_3, \text{ where m: 2-100}$$

which can be obtained by subjecting 2,2,3,3-tetrafluorooxetane to anionic polymerization in the presence of a cesium fluoride catalyst, followed by treating the resulting fluorine-containing polyether $(CH_2CF_2CF_2O)m$ with a fluorine gas at 160°-300° C. under ultraviolet irradiation.

Though these perfluoropolyether base oils can be used alone or in mixture thereof, it is desirable that the viscosity (according to JIS K-2283 corresponding to ASTM D446; 40° C.) is about 5 to about 2,000 $mm^2$/sec., preferably about 10 to about 1,500 $mm^2$/sec. If the viscosity is lower than about 5 $mm^2$/sec, the evaporation loss will be larger, resulting in failure to satisfy the conditions for a limit evaporation loss (less than 1.5%) set forth by JIS Ball-and-Roller Bearing Grease, Class 3, required for the heat-resistant grease, whereas, if the viscosity is higher than about 2,000 $mm^2$/sec, the flow point (JIS K-2283) will be 10° C. or higher, resulting in failure to turn the bearing at a low-temperature start-up according to the ordinary procedure, necessitating heating for the start-up, that is, unsuitable of the ordinary grease service.

The thickener for use in the present invention includes well-known fluororesins so far used in the field of grease, for example, powdery fluororesins having average primary particle sizes of generally not more than about 500 μm, preferably about 0.1 to about 30 μm, more preferably 0.1-10 μm, such as polytetrafluoroethylene (PTFE), tetrafluoroethylene-hexafluoropropene copolymer (FEP), tetrafluoroethylene-perfluoro(alkyl vinyl ether) copolymer, tetrafluoroethylene-ethylene copolymer, poly-(vinylidene fluoride), etc., preferably PTFE and FEP, more preferably PTFE, and can be used in a proportion of about 0.1 to about 50% by weight, preferably about 10 to about 40% by weight, on the basis of the grease composition. Below about 0.1% by weight, the fluororesin fails to show its thickening ability, resulting in deterioration such as oil separation, with no more improvement in anti-spattering and anti-leakage properties, whereas above 50% by weight, the grease composition will be too hard to show a satisfactory lubricability.

PTFE for use in the present invention has a number average molecular weight Mn of about 1,000 to about 500,000, which can be attained by treating polytetrafluoroethylene having a number average molecular weight Mn of about 1,000 to about 1,000,000 obtained by emulsion polymerization, suspension polymerization, solution polymerization, etc. of tetrafluoroethylene, by such a procedure as heat decomposition, electron beam irradiation decomposition, physical pulverization, etc. To preferably obtain PTFE having a melting point of 300° C. or higher, PTFE having a number average molecular weight Mn of 10,000 or more is used. Control of the molecular weight can be carried out by a chain transfer agent at the stage of copolymerization reaction. FEP having a number average molecular weight Mn of about 1,000 to about 600,000, obtained by the like copolymerization reaction and molecular weight reduction treatment, can be used.

Barium sulfate or antimony oxide for use in the present invention has an average primary particle size (determined by a scanning type electron microscope) of 0.1-20 μm, preferably 0.1-10 μm, and can be used in a proportion of about 1 to about 25% by weight, preferably about 1 to about 15% by weight on the basis of the grease composition. When barium sulfate or antimony oxide is used in a proportion of less than about 1% by weight, the abrasion resistance and the corrosion resistance will be deteriorated, whereas above about 25% by weight the grease composition will be too hard to give a satisfactory lubricability.

In addition to the afore-mentioned essential components it is possible to further add to the grease composition such well-known additives so far used in the lubricant such as an antioxidant, a rust inhibitor, a corrosion inhibitor, an extreme pressure agent, an oiliness agent, a solid lubricant, if required and depending to the required services.

Antioxidant, such as phenol-based antioxidants, e.g. 2,6-di-t-butyl-4-methylphenol, 4,4'-methylenebis(2,6-t-butylphenol), etc.; amine-based antioxidants, e.g. alkyldiphenylamine (whose alkyl group has 4-20 carbon atoms), triphenylamine, phenyl-α-naphthylamine, phenothiazine, alkylated phenyl-α-naphthylamine, alkylated phenothiazine, etc. can be used alone or in mixture of at least two thereof.

Rust inhibitor includes, for example, fatty acid, fatty acid soaps, alkyl sulfonates, fatty acid amines, paraffin oxides, polyoxyethylene alkyl ethers, etc.

Corrosion inhibitor includes, for example, benzotriazole, benzimidazole, thiadiazole, etc.

Extreme pressure agent include such phosphorus-based compounds as phosphoric acid esters, phosphorous acid esters, amine salts of phosphoric acid esters, etc.; such sulfur-based compounds as sulfides, disulfides, etc.; such chlorine-based compounds as chlorinated paraffins, chlorinated diphenyls, etc.; such organometallic compounds as zinc dialkyldithiophosphate (ZnDTP), molybdenum dialkyldithiocarbamate (MoDTP), etc.; and the like.

Oiliness agent includes, e.g. fatty acids, higher alcohols, polyhydric alcohols, polyhydric alcohol esters, aliphatic esters, aliphatic amines, fatty acid monoglycerides, etc.

Solid lubricant includes, e.g. molybdenum disulfide, graphite, boron nitride, silane nitride, etc.

The grease composition can be prepared, for example, by mixing predetermined amounts of a perfluoropolyether base oil, and additive components including a thickener and barium sulfate or antimony oxide, followed by thorough stirring, and then by thorough dispersion according to the ordinary dispersion method, for example, by a three-roll mill or a high pressure homogenizer.

EXAMPLES

The present invention will be described in detail below, referring to Examples.

Examples 1-13 And Comparative Examples 1-3

The following components (a), (b), and (c) each were kneaded in the afore-mentioned preparing method using a three-roll mill to prepare grease compositions. As to base oil component (a), values given in parentheses show a viscosity at 40° C.

Base Oil Component (a):

| | | |
|---|---|---|
| (a-1) | $RfO[CF(CF_3)CF_2O]mRf'$ | [230 $mm^2$/sec.] |
| (a-2) | $RfO[CF(CF_3)CF_2O]mRf'$ | [400 $mm^2$/sec.] |
| (a-3) | $RfO[CF(CF_3)CF_2O]mRf'$ | [800 $mm^2$/sec.] |
| (a-4) | $RfO[CF(CF_3)CF_2O]mRf'$ | [1200 $mm^2$/sec.] |
| (a-5) | $RfO[CF(CF_3)CF_2O]m(CF_2O)nRf'$ | [400 $mm^2$/sec.] |
| (a-6) | $RfO[CF(CF_3)CF_2O]m(CF_2O)nRf'$ | [700 $mm^2$/sec.] |
| (a-7) | $RfO(CF_2CF_2O)m(CF_2O)nRf'$ | [160 $mm^2$/sec.] |
| (a-8) | $RfO(CF_2CF_2O)m(CF_2O)nRf'$ | [320 $mm^2$/sec.] |
| (a-9) | $F(CF_2CF_2CF_2O)mC_2F_5$ | [100 $mm^2$/sec.] |

Thickener Component (b):

(b-1) PTFE (made by emulsion polymerization, number average molecular weight Mn: $100\times10^3$-$200\times10^3$, and average primary particle size: 0.2 μm)

(b-2) PTFE (made by suspension polymerization, number average molecular weight Mn: $10\times10^3$-$100\times10^3$, and average primary particle size: 5 μm)

(b-3) FEP (made by solution polymerization, number average molecular weight Mn: $50\times10^3$-$150\times10^3$, and average primary particle size: 0.2 μm)

Additive Component (c):

(c-1) barium sulfate (average primary particle size: 5 μm)

(c-2) antimony oxide (average primary particle size: 5 μm)

(c-3) $C_3F_7O[CF_2CF(CF_3)O]uCF(CF_3)(CH_2)_2OPO(OC_6H_5)_2$ $2 \leqq u \leqq 8$ (c-4) graphite Compositions obtained in the following Examples and Comparative Examples were subjected to determination of the following items:

Percent evaporation loss test: Percent evaporation loss of grease was determined by applying 0.4 g of grease to an aluminum dish, 36 mm in diameter, and retaining it at 200° C. for 24 hours Abrasion resistance test: Test pieces, ¾ inch in size and grade 20, were tested with a Shell 4-balls test machine under such conditions as temperature: room temperature, oil hydraulic pressure: 2.0 kgf/cm$^2$, and revolution rate: 200 rpm, for the duration of 30 minutes to determine abrasion trace diameter MKO test (corrosion ranking) according to DIN 51802: 10 ml of grease was sealed into 1306K bearing, followed by mounting on an MKO tester, and after filling 30 ml of distillated water in the tester, test was carried out under such conditions as revolution rate: 80 rpm, and revolution cycles: revolution run for 8 hours→revolution interruption for 16 hours→revolution run for 8 hours→revolution interruption for 16 hours→revolution run for 8 hours→revolution interruption for 108 hours (total duration: 164 hours), to evaluate the corrosion state on the track surface of the bearing outer race, according to the following evaluation standard:

| Corrosion ranking | Appearance | Evaluation standard |
|---|---|---|
| 0 | no corrosion | no change |
| 1 | traces of corrosion | up to 3 corrosion points, less than 1 mm in size |
| 2 | weakly corroded | corrosion above corrosion ranking 1 with corroded parts covering less than 1% of the surface |
| 3 | corroded | corrosion with corroded parts covering 1% to less than 5% of the surface |
| 4 | strong corroded | corrosion with corroded parts covering 5% to less than 10% of the surface |
| 5 | vary strongly corroded | corrosion with corroded parts covering 10% or more of the surface |

Composition proportion (% by weight) and results of determinations of Examples and Comparative Examples are given in the following Table:

TABLE

| Ex. No. | Base oil | Thickener | Additive | Evaporation loss (%) | Abrasion resistance test (mm) | Corrosion ranking |
|---|---|---|---|---|---|---|
| Ex. 1 | (a-1) 60 | (b-1) 30 | (c-1) 10 | 2.1 | 0.63 | 0 |
| Ex. 2 | (a-1) 62 | (b-2) 37 | (c-1) 1 | 2.3 | 0.78 | 0 |
| Ex. 3 | (a-1) 66 | (b-3) 19 | (c-1) 15 | 2.5 | 0.59 | 0 |
| Ex. 4 | (a-1) 63 | (b-1) 27 | (c-2) 10 | 2.3 | 0.66 | 0 |
| Ex. 5 | (a-2) 60 | (b-1) 35 | (c-1) 5 | 1.9 | 0.67 | 0 |
| Ex. 6 | (a-2) 55 | (b-2) 40 | (c-1) 5 | 1.8 | 0.67 | 0 |
| Ex. 7 | (a-3) 58 | (b-2) 37 | (c-2) 5 | 1.0 | 0.65 | 0 |
| Ex. 8 | (a-4) 75 | (b-3) 22 | (c-2) 3 | 0.5 | 0.69 | 0 |

TABLE-continued

| Ex. No. | Base oil | Thickener | Additive | Evaporation loss (%) | Abrasion resistance test (mm) | Corrosion ranking |
|---|---|---|---|---|---|---|
| Ex. 9 | (a-5) 55 | (b-1) 15<br>(b-2) 20 | (c-1) 10 | 4.1 | 0.64 | 0 |
| Ex. 10 | (a-1) 35<br>(a-6) 35 | (b-2) 25 | (c-2) 5 | 5.2 | 0.65 | 0 |
| Ex. 11 | (a-7) 63 | (b-1) 27 | (c-1) 5<br>(c-4) 5 | 1.8 | 0.81 | 0 |
| Ex. 12 | (a-2) 30<br>(a-8) 30 | (b-1) 15<br>(b-2) 20 | (c-1) 5 | 1.6 | 0.70 | 0 |
| Ex. 13 | (a-9) 70 | (b-3) 10 | (c-1) 20 | 1.8 | 0.82 | 0 |
| Comp. Ex. 1 | (a-1) 65 | (b-1) 35 | | 2.5 | 1.00 | 5 |
| Comp. Ex. 2 | (a-7) 55 | (b-1) 35 | (c-3) 10 | 11.6 | 0.71 | 5 |
| Comp. Ex. 3 | (a-9) 55 | (b-2) 40 | (c-4) 5 | 1.5 | 0.87 | 5 |

INDUSTRIAL UTILITY

The present grease composition can be effectively used in such service fields as the perfluoropolyether has been so far used, for example, service fields based on any of sliding modes such as rotation, reciprocation, sliding, rocking, etc. such as ball-and-roller bearings, plain bearings, sintered bearings, gears, valves, cocks, oil seals, electric contacts, etc.: service fields requiring the heat resistance, low-temperature durability and load durability, typically such as automobile parts, for example, fuel injection units such as idling revolution number control units, exhaust gas recycle units, electron throttle control units, etc., hub units, traction motors, alternators, etc.; service fields requiring the abrasion resistance or low-friction characteristics, typically such as power transmission units, power wind motors, wipers, etc., of automobiles; service fields requiring abrasion durability, low-friction characteristics, and heat resistance, typically such as bearings, lanes, chains, etc., of production lines; service fields requiring high speed, low friction coefficient, and low-outgassing property, typically such as hard disc drives, flexible disc memory units, compact disc drives, and photomagnetic disc drives of communication appliances; business machine motors, typically such as LBP scanner motors as business appliance; motors to be used at high temperatures such as domestic electric appliance parts, acoustic appliance parts, etc., and the like.

The invention claimed is:

1. A grease composition, which consists essentially of (A) a perfluoropo lyether base oil, (B) a thickener, and (C) at least one of barium sulfate and antimony oxide.

2. A grease composition according to claim 1, wherein the component (B) and the component (C) are contained in proportions of 0.1-50% by weight and 1-25% by weight, respectively, on the basis of the grease composition.

3. A grease composition according to claim 1, wherein the thickener component (B) is powdery polytetrafluoroethylene, or tetrafluoroethylene-hexafluoropropene copolymer.

4. A grease composition according to claim 1, wherein the barium sulfate, antimony oxide, or a mixture thereof as component (C) has an average primary particle size of 0.1-20 μm.

* * * * *